US009147536B2

(12) United States Patent
Lee

(10) Patent No.: US 9,147,536 B2
(45) Date of Patent: Sep. 29, 2015

(54) KEYBOARD

(71) Applicant: Hyung Tae Lee, Seoul (KR)

(72) Inventor: Hyung Tae Lee, Seoul (KR)

(73) Assignees: Wenyu Zhang, Beijing (CN); LEETIS TECHNOLOGY DEVELOPMENT (HK) COMPANY LIMITED, Kowloon (HK)

( * ) Notice: Subject to any disclaimer, the term of this patent is extended or adjusted under 35 U.S.C. 154(b) by 159 days.

(21) Appl. No.: 13/726,869

(22) Filed: Dec. 26, 2012

(65) Prior Publication Data

US 2013/0228436 A1 Sep. 5, 2013

(30) Foreign Application Priority Data

Mar. 5, 2012 (KR) ..... 10-2012-0022192

(51) Int. Cl.
*H01H 13/83* (2006.01)
*H01H 13/84* (2006.01)

(52) U.S. Cl.
CPC ..... *H01H 13/84* (2013.01); *H01H 13/83* (2013.01); *H01H 2215/012* (2013.01)

(58) Field of Classification Search
CPC ..... H01H 13/83; H01H 3/125
USPC ..... 200/310, 314, 5 A, 344
See application file for complete search history.

(56) References Cited

U.S. PATENT DOCUMENTS

| | | | | |
|---|---|---|---|---|
| 7,842,895 | B2 * | 11/2010 | Lee | 200/344 |
| 8,119,945 | B2 * | 2/2012 | Lin | 200/314 |
| 2010/0147662 | A1 * | 6/2010 | Yeh et al. | 200/314 |
| 2010/0252407 | A1 * | 10/2010 | Merminod et al. | 200/5 A |

* cited by examiner

*Primary Examiner* — Renee Iuebke
*Assistant Examiner* — Ahmed Saeed
(74) *Attorney, Agent, or Firm* — Anova Law Group, PLLC

(57) ABSTRACT

A keyboard includes a keyboard shell, a supporting panel, a plurality of keycaps, a plurality of keycap supports between the supporting panel and the corresponding keycaps; a plurality of elastomers through the corresponding elastomer holes; and a key signal pad substrate with a plurality of key signal pad corresponding to the elastomer hole; the elastomer includes a top part, an elastic supporting part, the elastomer is arranged on the key signal pad substrate; and a conductive layer arranged on the bottom surface of the pressure enhancing protrusion; the pressure enhancing protrusions are corresponding to the key signal pad, respectively, when pressure is supplied on the keycap, the corresponding pressure enhancing protrusion is pressed and make the conductive layer electrically connect to the key signal pad, the pressure enhancing protrusion is supported on the key signal pad substrate by the elastic supporting part.

20 Claims, 9 Drawing Sheets

KEYBOARD

FIELD OF THE INVENTION

The present disclosure relates to the art of keyboards and, particularly to a keyboard having backlight which illuminates light from the bottom of the keycap.

DESCRIPTION OF RELATED ART

Keyboards usually are used for inputting signals to computers by tapping key bodies. Herein in this invention keyboard is an input device used for computer, portable computer and other devices having signals inputting.

Recently, a keyboard that can be used in dim with accurate operations and having light beams irradiated from undersides of the keycaps to the keycaps has been disclosed.

FIG. 8 is an exploded view of a conventional keyboard. FIG. 9 is a cross-sectional view of part of the conventional keyboard of FIG. 8. FIG. 10 is a cross-sectional view of an FPC sheet of the conventional keyboard of FIG. 8.

The conventional keyboard as shown in FIGS. 8-10, a typical keyboard includes a keyboard shell 111, a supporting panel 112 integrated with the keyboard shell 111, and the supporting panel 112 has a plurality of elastomer holes 112*a* therein, a plurality of keycaps 113 arranged on the elastomer holes 112*a*, a plurality of keycap supports 130 against the supporting panel 112 for supporting the keycap 113, an elastomer panel 150 arranged under the supporting panel 112, a light defusing panel 117 under the FPC sheet 160, a light emitting part 140 with a light emitting substrate 141 arranged under the light defusing panel 117, a main board (not shown) electrically connecting the FPC sheet 160 and the light emitting part 140, and a rear panel 118 arranged under the light emitting substrate 160.

The keyboard shell 111 with the above described structure can be made of material of metal or metal alloy, such as aluminum, or can be made of material of hard synthetic resin.

The supporting panel 112 is exposed at the upper side of the keyboard shell 111, and integrated with the keyboard shell 111.

The keycap support 130 is constituted with an up-down guide portion 131 formed in an underside of the keycap 113, a pressure portion 132 formed inside of the up-down guide portion 131 and a guide rail 133 formed within a scope of a perimeter of an elastomer hole 112*a* of the supporting panel 112.

The up-down guide portion 131 has a protrusion 131*a* in a bottom end thereof. The pressure portion 132 has its bottom end contacting with a top end of an elastomer 151. The guide rail 133 has a limit corner 133*a* in its upper part.

The protrusion 131*a* and the limit corner 133*a* can be buckled with each other.

The keycap support 130 has such a configuration that the keycap 113 is closed to the supporting panel 112 when pressed down.

The flexible board 150 has elastomers 151 corresponding to the elastomer holes 112*a*. The elastomer 151 is arch shaped overall, and a pressure enhancing protrusion 151*a* is formed inside.

The elastomer 151 can be made of rubber or other elastic and transparent materials.

The FPC sheet 160 includes a middle insulative layer 162, an upper layer 161 and a lower layer 163 arranged at the two sides of the insulative layer 160, respectively, and outer connecting pads 164 electrically connecting with the upper layer 161 and the lower layer 163.

The insulation layer 162 has a plurality of contact holes 162*a* corresponding to the elastomer holes 112*a* defined therein.

The upper layer 161 and the lower layer 163 have upper contact points 161*a* and lower contact points 163*a* respectively which have the same configuration as the elastomer holes 112*a*.

The outer connecting pads 164 is electrically connected to the upper contact points 161*a*, the lower contact points 163*a* and the main board (not shown).

With the above described structure, when the elastomer 151 is pressed by the keycap 113, as described later, a pressure protrusion 151*a* provides pressure to the upper key signal pad 161*a*, then the upper key signal pad 161*a* passes through the corresponding contact hole 162*a* and connects the lower key signal pad 163*a*.

When the upper key signal pad 161*a* is connected to the lower key signal pad 163*a*, the key signal is in ON state.

When the pressure is released from the keycap 113, the upper key signal pad 163*a* is separated from the lower key signal pad 163*a*, then the key signal is in OFF state.

The ON state and OFF state signals are transmitted to the main body of a computer through the outer connecting pads 163 and the main board (not shown).

An arch-shaped lens 117*a* formed on the light defusing panel 117 is arranged under the elastomer 151. The light emitting part 140 includes a light emitting substrate 141 and some light emitting members 142 arranged on the light emitting substrate 141.

The light emitting substrate 141 is preferably selected from ceramic PCB and such high-temperature substrates.

The light emitting substrate 141 is electrically connected to the main board (not shown).

Light emitting driver chips are arranged on the light emitting substrate 141. The light emitting driver chips receive light emitting control signals from the computer or keyboard MCU IC via the main board (not shown), and drive the light emitting members 142 to emit light beams.

The light emitting members 142 can be light emitting diodes (LEDs).

The light emitting members 142 with the above described structure is arranged on the light emitting substrate 141, and are under the arch-shaped lens 117*a*.

Light beams emitted from the light emitting members 142 cross the arch-shaped lens 117*a* and the elastomer 151, and reach the upper side of the supporting panel 112.

The driving voltage of the light emitting member 142 is from a battery disposed on the keyboard shell 111 or from the main body of a computer.

The main board (not shown) is electrically connected to the computer via electric codes.

The rear panel 118 is bounded onto the keyboard shell 111 with some screws.

In the following, the assembling method of the above-described keyboard will be disclosed.

Firstly, the keycaps 113 are installed. The keycap support 130 is supported on the supporting panel 112.

Finally, when the flexible board 150, the FPC sheet 160, the light defusing panel 117, and the light emitting substrate 141 are installed between the keyboard shell 111 and the rear panel 118, the rear panel 118 is fastened to the keyboard shell 111 by screws.

The above described keyboard is disclosed in Korean patent with patent application number 54613 (named as illuminating keyboard).

However, the elastomer 151 are formed on the elastomer panel 150. In order to receive the FPC sheet 160 and the light emitting substrate 141, the rear panel 118 must be concave. This increases the total thickness of the keyboard and is not convenient for the user.

Therefore, it is desirable to provide a keyboard which can overcome the above-mentioned problem.

SUMMARY

This invention discloses a keyboard with decreased thickness.

A keyboard includes: a keyboard shell; a supporting panel arranged to the keyboard shell and having a plurality of elastomer holes therein; a plurality of keycaps arranged on the corresponding elastomer holes; a plurality of keycap supports between the supporting panel and the corresponding keycaps; a plurality of elastomers through the corresponding elastomer holes and being exposed out of the supporting panel; and a key signal pad substrate with a plurality of key signal pad corresponding to the elastomer holes respectively arranged under the supporting panel; the elastomer includes a top part, an elastic supporting part which extends from the top part and defines a pressure enhancing protrusion under the top part, the elastomer is arranged on the key signal pad substrate, and a conductive layer arranged on the bottom surface of the pressure enhancing protrusion; the pressure enhancing protrusions are corresponding to the key signal pad, respectively, when pressure is provided on the keycap, the corresponding pressure enhancing protrusion is pressed and make the conductive layer electrically connect to the key signal pad, the pressure enhancing protrusion is supported on the key signal pad substrate by the elastic supporting part.

Furthermore, the keyboard further includes a plurality of light emitting members corresponding to the elastomers respectively, the light emitting members are arranged on the key signal pad substrate.

Furthermore, the keycap support has a cross structure, the top of the keycap support is jointed to the keycap, and the bottom of the keycap support is jointed to the supporting panel, the keycap support has a scissors-like structure.

Furthermore, the key signal pad substrate is selected from metal PCB, ceramic PCB and FPC.

Furthermore, the keyboard as claimed in claim 1, the elastomer is made of transparent material.

Furthermore, the keyboard shell is made of material of metal or metal alloy or hard synthetic resin.

Furthermore, a cross-sectional area of the elastomer hole is greater than that of the elastomer, the space between the elastomer hole and the elastomer define a light through area.

This invention has a single layer of FPC sheet, and a conduction layer on the elastomer. A key signal pad is formed on the FPC sheet. When the keycap is pressed down, the pressure enhancing protrusion is pressed down as well and contacts the conduction layer (ON state), thus such single layer FPC makes the thickness of the keyboard is reduced.

DETAILED DESCRIPTION

Reference will now be made to describe an exemplary embodiment of the present disclosure in detail.

Figure 1:
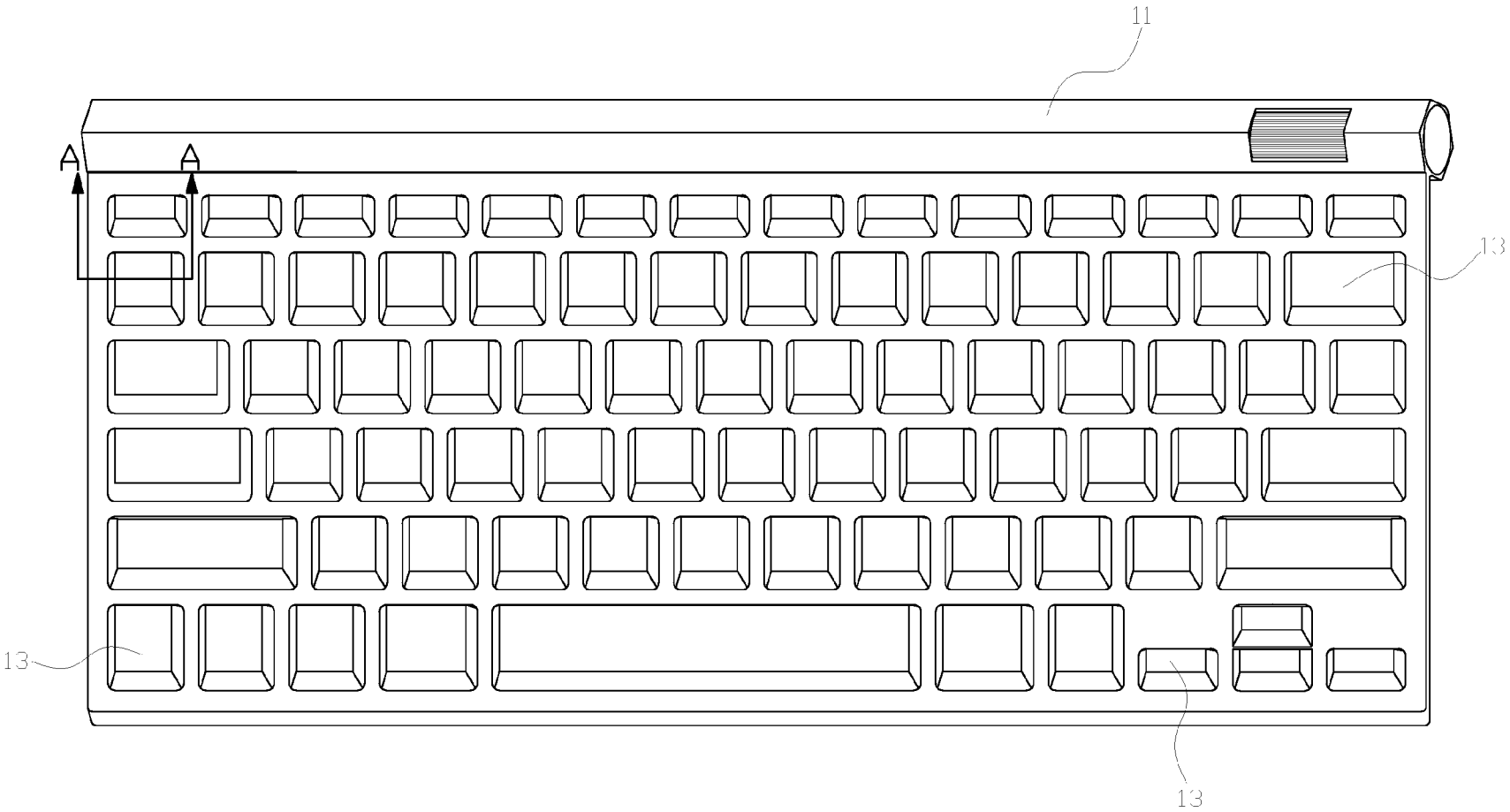
FIG. 1 is an illustrative view of a keyboard in accordance with an exemplary embodiment of the present invention.
Figure 2:
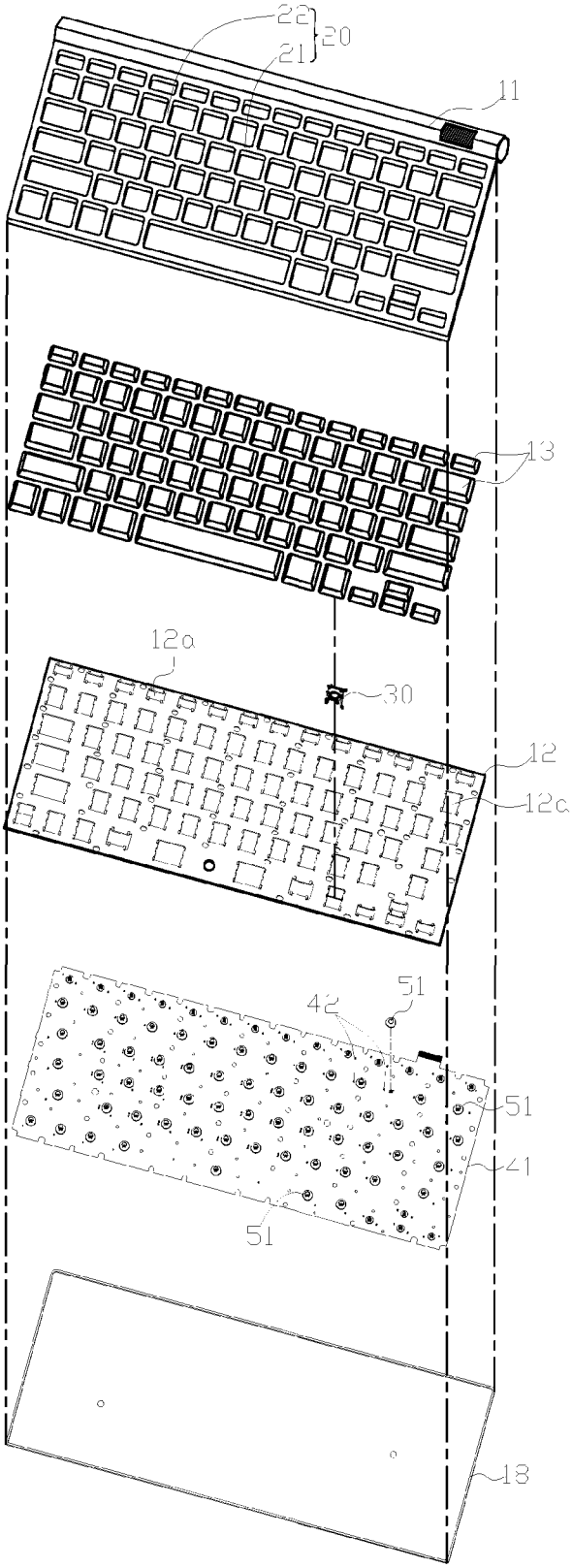
FIG. 2 is an exploded view of the keyboard in accordance with an exemplary embodiment of the present invention.
Figure 3:
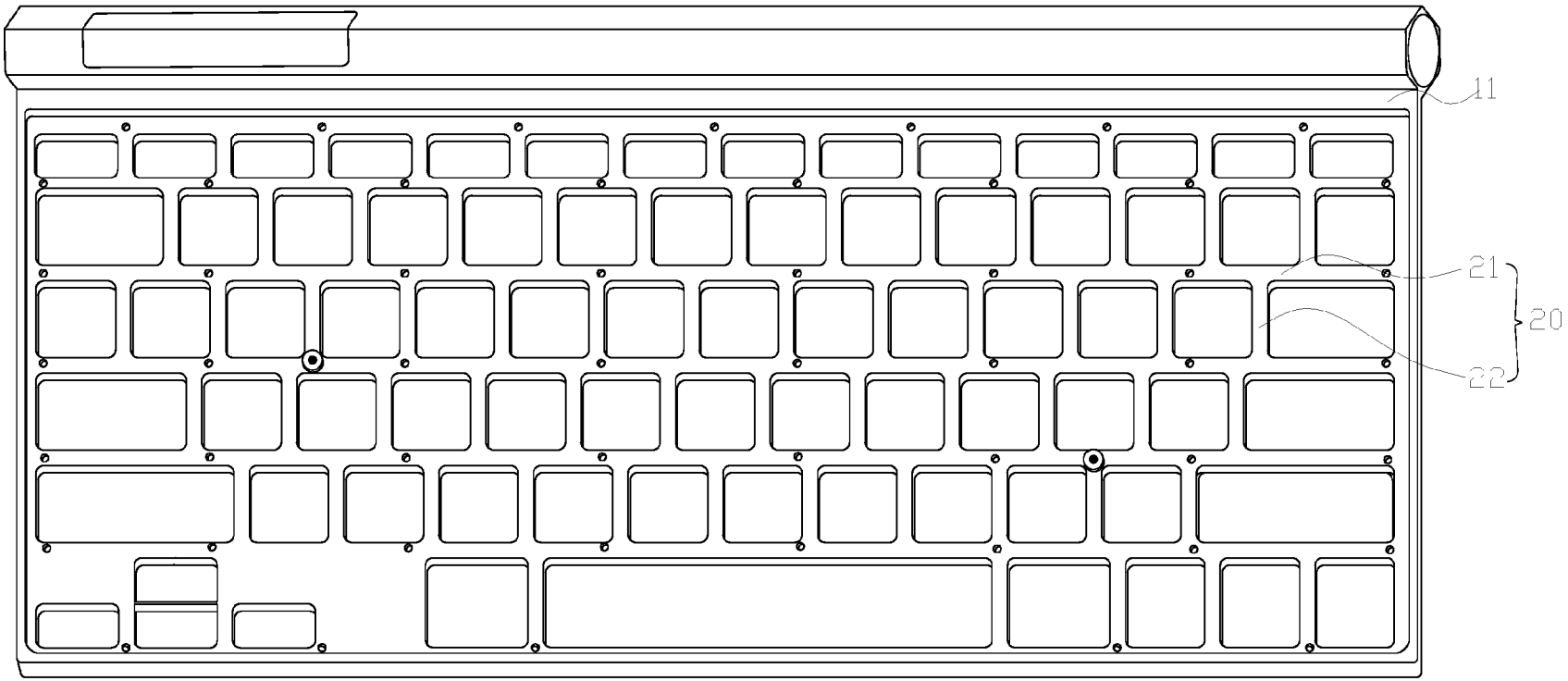
FIG. 3 is an illustrative back view of a keyboard shell of the keyboard of FIG. 2.
Figure 4:
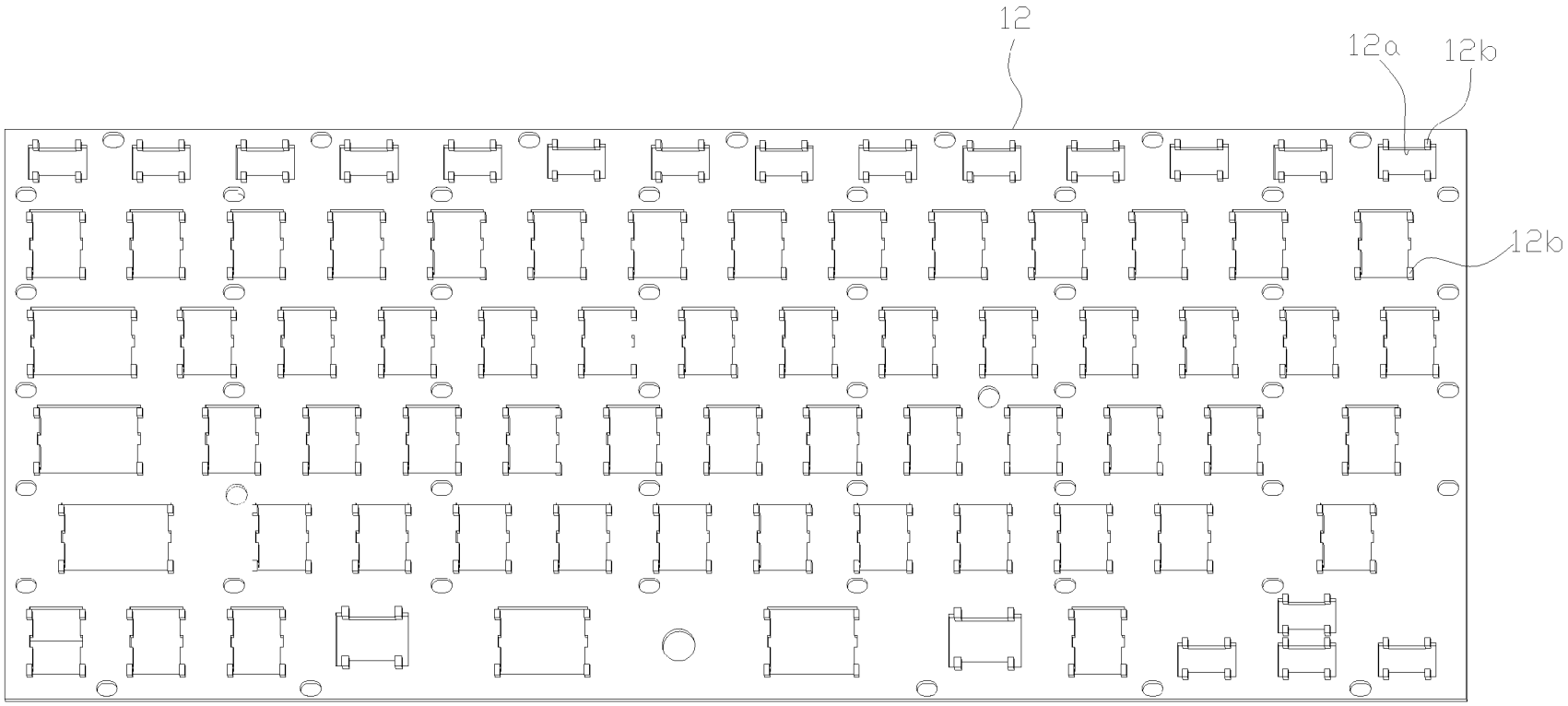
FIG. 4 is a plan view of a supporting panel of the keyboard of FIG. 2.
Figure 5:
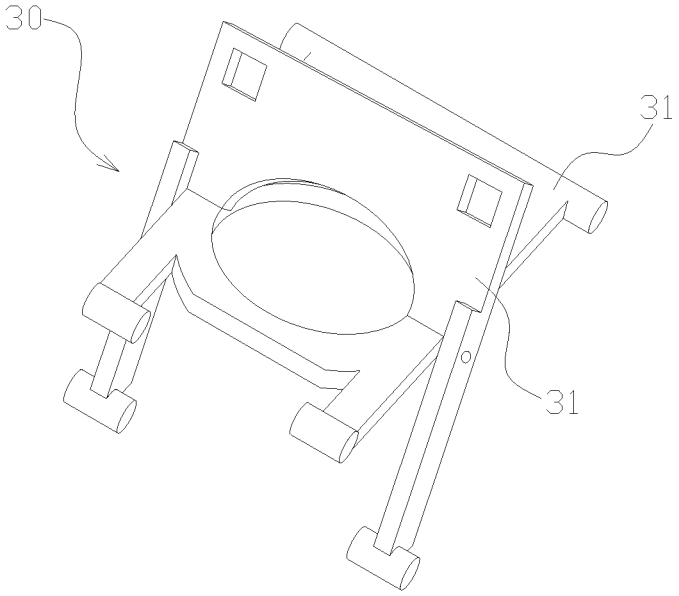
FIG. 5 is an illustrative view of a keycap support of the keyboard of FIG. 2.
Figure 6:
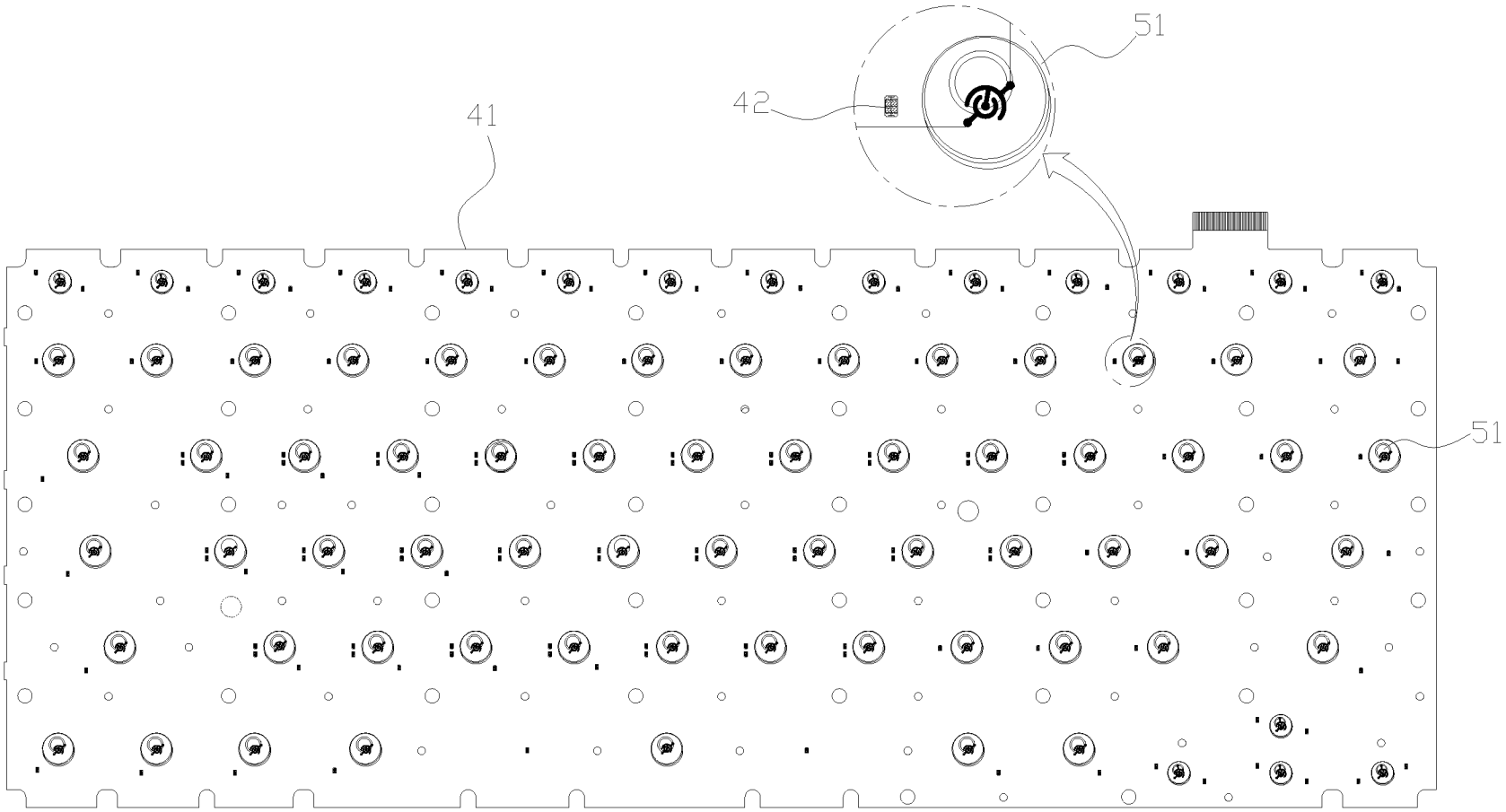
FIG. 6 is an illustrative view of a light emitting substrate of the keyboard of FIG. 2.
Figure 7:
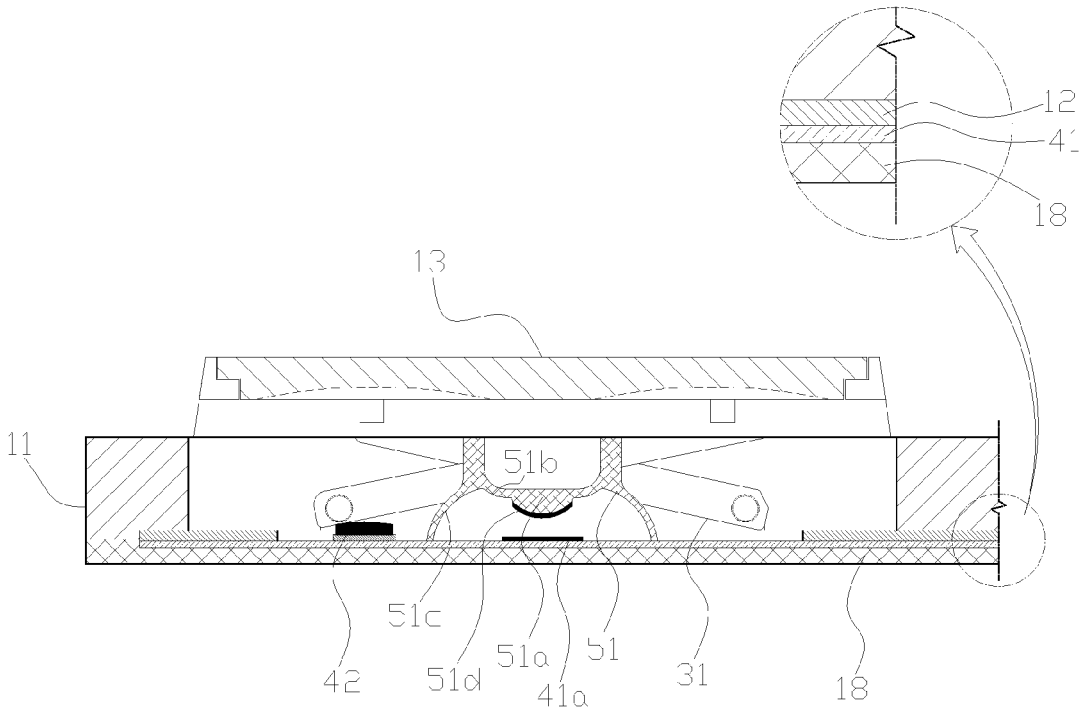
FIG. 7 is an enlarged cross-sectional view of the keyboard along line A-A in FIG. 1.
Figure 8:
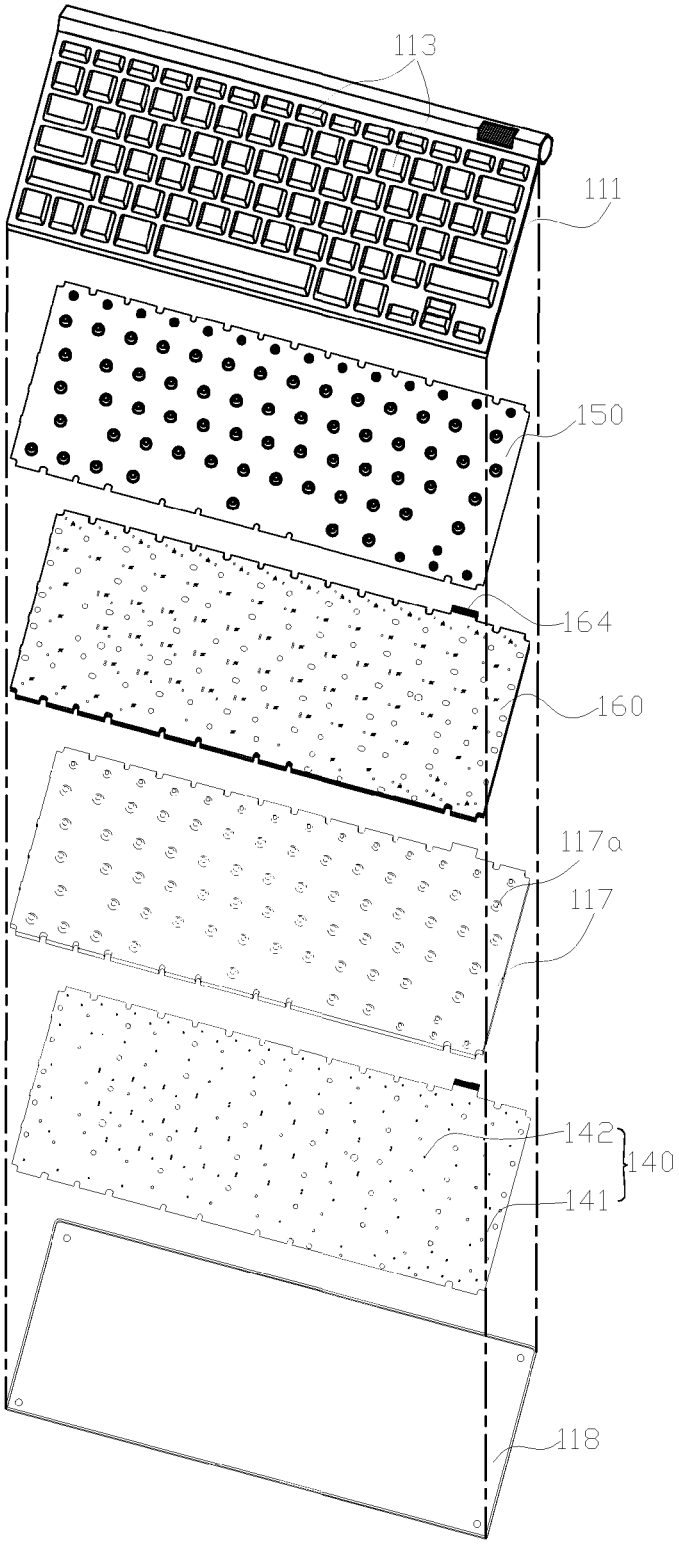
FIG. 8 (Prior Art)
FIG. 8 is an exploded view of a conventional keyboard.
Figure 9:
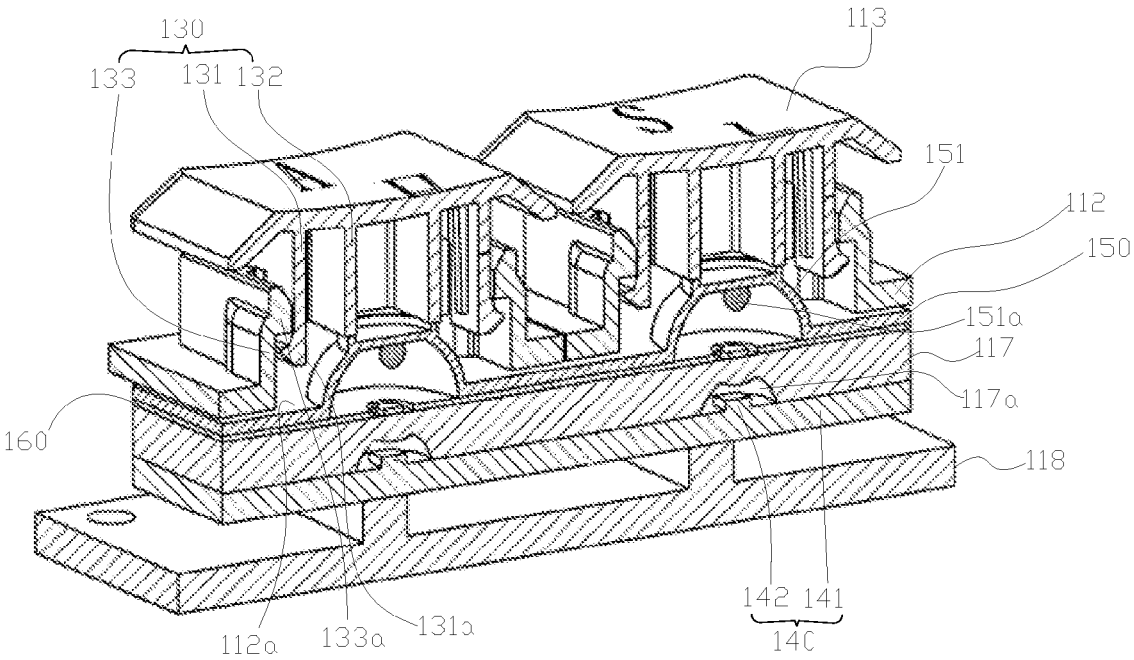
FIG. 9 (Prior Art)
FIG. 9 is a cross-sectional view of part of the conventional keyboard of FIG. 8.
Figure 10:
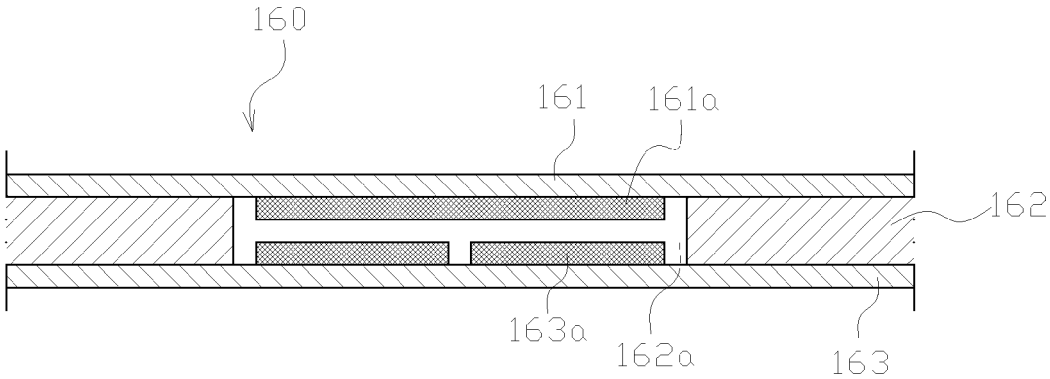
FIG. 10 (Prior Art)
FIG. 10 is a cross-sectional view of an FPC sheet of the conventional keyboard of FIG. 8.

FIG. 1 is an illustrative view of a keyboard in accordance with an exemplary embodiment of the present invention; FIG. 2 is an exploded view of the keyboard in accordance with an exemplary embodiment of the present invention; FIG. 3 is an illustrative back view of a keyboard shell of the keyboard of FIG. 2; FIG. 4 is an illustrative plan view of a supporting panel of the keyboard of FIG. 2; FIG. 5 is an illustrative view of a keycap support of the keyboard of FIG. 2; FIG. 6 is an illustrative plan view of a light emitting substrate of the keyboard of FIG. 2; FIG. 7 is an enlarged cross-sectional view of the keyboard along line A-A in FIG. 1.

The keyboard of the present invention as illustrated in the FIGS. 1-7, includes a keyboard shell 11, a supporting platform 20 formed on the keyboard shell 11, a supporting panel 12 arranged to the keyboard shell 11 with a plurality of elastomer holes 12*a*, a plurality of keycaps 13 arranged on the elastomer holes 12*a*, a plurality of keycap supports 30 against the supporting panel 12 for supporting the keycap 13, a key signal pad substrate 41 arranged under the supporting panel 12, a plurality of elastomers 51 arranged on the key signal pad substrate 41, a plurality of light emitting members 42 arranged on the key signal pad substrate 41, a main board (not shown) electrically connecting the a key signal pad substrate 41, and a rear panel 18 arranged under the a key signal pad substrate 41.

The keyboard shell 11 with the above described structure can be made of material of metal or metal alloy, such as aluminum, or can be made of material of hard synthetic resin.

The supporting platform 20 includes a plurality of horizontal parts 21 and a plurality of vertical parts 22 connected with each other, thereby forming a plurality of grids arranged in matrix. The horizontal parts 21 have screw holes 21*a* formed on its bottom. The grids formed by the horizontal parts 21 and the vertical parts 22 do not interfere the elastomers 51 and the keycap supports 30. The supporting platform 20 reaches the top of the supporting panel 12.

Four supporting protrusions 12*b* around each elastomer hole 12*a* are formed on the supporting panel 12. A cross-sectional area of the elastomer holes 12*a* is preferably greater than that of the elastomers 51. The space between the elastomer holes 12*a* and the elastomer 51 define a plurality of light through holes 12*a*.

The keycap support 30 has a cross structure. The top of the keycap support 30 is jointed to the keycap 13, and the bottom of the keycap support 30 is jointed to the connecting parts 31 of the four supporting protrusions 12*b*. The keycap support 30 has a scissors-like structure.

The keycap support 30 can be any of the conventional key cap support, and the detailed structure of the keycap support 30 is omitted.

With the above described structure, when the keycap 13 is pushed down, the keycap 13 is close to the top of the supporting panel 12.

Besides of the scissors-like structure, the keycap support 30 can also be any other exited structure, such as the mechanical keycap support with a up-down guiding slide.

The key signal pad substrate 41 is preferably selected from metal PCB, ceramic PCB and such high-temperature substrates.

A plurality of key signal pad 41*a* corresponding to the plurality of elastomer holes 12*a* are arranged on the upper side of the key signal pad substrate 41.

The key signal pad substrate 41 is electrically connected to the main board (not shown).

The ON state and OFF state signal of the plurality of key signal pad 41*a* are transmitted to the main body of a computer.

Light emitting driver chips (not shown) are arranged on the key signal pad substrate 41. The light emitting driver chips receive light emitting control signals from the computer or a keyboard MCU IC, and drive the light emitting members 42 to emit light beams.

The key signal pad substrate 41 is arranged under the supporting panel 12, and the key signal pad 41*a* are corresponding to the elastomer holes 12*a*, respectively.

The elastomer 51 includes a top part 51*b*, an elastic supporting part 51*c* which extends from the top part 51*b* and defines a pressure enhancing protrusion 51*a* under the top part 51*b*. A conductive layer 51*d* is arranged on the surface of the pressure enhancing protrusion 51*a*.

When the elastomer 51 with the above described structure is pressed by the keycap 13 with pressure towards the key signal pad 41*a*, the conductive layer 51*d* is pressed to connect the key signal pad 41*a* through the corresponding elastomer hole 12*a*. The elastomer 51 extends out of the elastomer hole 12*a*. The elastomer 51 can be adhered on the key signal pad substrate 41 via adhensive material.

The elastomers 51 can be made of rubber or other elastic or transparent materials. In this invention, the semitransparent material is also included.

The light emitting members 42 are arranged on the key signal pad substrate 41, and the light emitting members 42 is in correspondence with the elastomer panels 51.

The light emitting members 42 exposed at the upper side of the supporting panel 12 through the corresponding elastomer holes 12*a*. When the light emitting member 42 emits light, the light beams go through the elastomer holes 12, and reach the upper side of the supporting panel 12.

The light emitting members 42 can be light emitting diodes (LEDs).

The driving voltage of the light emitting member 42 is from a battery disposed in the keyboard shell 11 or from the computer.

The main board (not shown) is electrically connected to the computer via certain communication codes. Or, the main board can be electrically connected with the computer wirelessly via certain communication codes.

The rear panel 18 has a caved fixing portion and can be fastened to the keyboard shell 11 by using screws or other integration process without any thickness increase caused by the screw head or other mechanical process.

The process of assembling the keyboard with above described structure is described as follows.

First of all, the keycap supports 30 are arranged on the supporting panel 12. Then the keycaps 13 are arranged on the keycap supports 30. Then the key signal pad substrate 41 is screwed to the supporting panel 12.

Finally, the supporting panel 12 and the key signal pad substrate 41 are arranged between the keyboard shell 11 and the rear panel 18, the rear panel 18 is fastened with the keyboard shell 11 using screws or other mechanical integration process.

As the described embodiment of the invention, conductive layer 51*d* is arranged under the bottom of the elastomer 51. When the pressure enhancing protrusion 51*a* is pressed, the conductive layer 51*d* is electrically connected to the key signal pad 41*a* on the key signal pad substrate 41, thereby making an ON state signal. Thus the whole thickness of the keyboard is reduced.

The light emitting members 42 are directly arranged on the upper side of the key signal pad substrate 41, this is also helpful for reducing the thickness of the keyboard.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A keyboard comprising:

a keyboard shell;

a supporting panel having a plurality of elastomer holes therein;

a plurality of keycaps;

a plurality of keycap supports between the supporting panel and the corresponding keycaps;

a key signal pad substrate, the key signal pad substrate comprising a plurality of key signal pads corresponding to the elastomer holes respectively;

a plurality of elastomers arranged on the key signal pad substrate and extending out of the elastomer holes of the supporting panel respectively; and a plurality of light emitting members corresponding to the elastomers respectively, the light emitting members being mounted on and directly contacting a same surface of the key signal pad substrate as the key signal pads;

wherein the supporting panel is configured for supporting and fixing the keycap supports, and is disposed on the key signal pad substrate; each of the light emitting members is exposed at an upper side of the supporting panel through a corresponding elastomer hole of the supporting panel.

2. The keyboard as claimed in claim 1, wherein the light emitting members are disposed around the elastomers on the key signal pad substrate.

3. The keyboard as claimed in claim 1, wherein the keycap support has a cross structure, a top of the keycap support is jointed to the keycap.

4. The keyboard as claimed in claim 1, wherein the key signal pad substrate is selected from a metal PCB, a ceramic PCB and a high temperature PCB.

5. The keyboard as claimed in claim 1, the elastomer is made of transparent material.

6. The keyboard as claimed in claim 1, wherein the keyboard shell is made of metal, metal alloy or hard synthetic resin.

7. The keyboard as claimed in claim 1, wherein a cross-sectional area of the elastomer hole is greater than that of the elastomer, and a space between the elastomer hole and the elastomer define a light through area.

8. The keyboard as claimed in claim 7, wherein the elastomer and a corresponding light emitting member thereof are arranged at a same elastomer hole of the supporting panel.

9. The keyboard of claim 1, wherein when a keycap is pressed down, the elastomer corresponding to the keycap contacts a key signal pad region of the key signal pad substrate.

10. The keyboard of claim 9, wherein each of the elastomers comprises a top portion, an elastic supporting portion extending from the top portion, a pressure enhancing protrusion formed under the top portion, and a conductive layer arranged on a surface of the pressure enhancing protrusion; the pressure enhancing protrusion is opposite to a corresponding key signal pad, and when the keycap is pressed down, the conductive layer of the elastomer contacts the key signal pad on the key signal pad substrate.

11. The keyboard of claim 1, wherein four supporting protrusions around each of the elastomer holes are formed on the supporting panel, and a bottom of a keycap support corresponding to the elastomer hole is jointed to the four supporting protrusions.

12. The keyboard of claim 1, wherein each of the keycap supports is a mechanical keycap support with an up-down guiding slide.

13. The keyboard of claim 4, further comprising light emitting driver chips for driving the light emitting members to emit light beams, wherein the light emitting driver chip is arranged on the key signal pad substrate.

14. The keyboard of claim 13, wherein the key signal pad substrate is screwed to the supporting panel.

15. A keyboard comprising:

a plurality of keycaps;

a supporting panel having a plurality of elastomer holes therein;

a plurality of keycap supports between the supporting panel and the corresponding keycaps;

a key signal pad substrate, the key signal pad substrate comprising a plurality of key signal pads corresponding to the elastomer holes respectively, the key signal pads are formed on a surface of the key signal pad substrate;

a plurality of elastomers arranged on the key signal pad substrate and extending out of the elastomer holes of the supporting panel respectively; and a plurality of light emitting members corresponding to the elastomers respectively, the light emitting members being mounted on the surface of the key signal pad substrate, whose electronic circuit layout contains pads that directly contacts the light emitting members;

wherein the supporting panel is configured for supporting and fixing the keycap supports, and is disposed on the key signal pad substrate; each of the light emitting members is exposed at an upper side of the supporting panel through a corresponding elastomer hole of the supporting panel.

16. The keyboard of claim 15, wherein four supporting protrusions around each of the elastomer holes are formed on the supporting panel, and a bottom of a keycap support corresponding to the elastomer hole is jointed to the four supporting protrusions.

17. The keyboard as claimed in claim 1, wherein the keycap support has a scissors-like structure, a top of the keycap support is jointed to the keycap.

18. The keyboard of claim 1, wherein each of the keycap supports is a mechanical keycap support with an up-down guiding slide.

19. The keyboard of claim 18, further comprising light emitting driver chips for driving the light emitting members to emit light beams, wherein the light emitting driver chip is arranged on the key signal pad substrate.

20. The keyboard of claim 19, wherein the key signal pad substrate is screwed to the supporting panel.

* * * * *